US005643095A

United States Patent [19]

Probst

[11] Patent Number: 5,643,095

[45] Date of Patent: Jul. 1, 1997

[54] BILLIARD CUE HAVING AN AXIAL ALIGNING SHAFT-HANDLE CONNECTOR

[76] Inventor: Frederick Ernest Probst, 1218 Vitalia St., Santa Fe, N.M. 87501

[21] Appl. No.: 491,406

[22] Filed: Jun. 16, 1995

Related U.S. Application Data

[63] Continuation-in-part of Ser. No. 354,243, Dec. 12, 1994, abandoned.

[51] Int. Cl.[6] ..... A63D 15/08

[52] U.S. Cl. ..... 473/44

[58] Field of Search ..... 473/44, 45, 46, 473/47, 48, 49; 403/288, 348, 41

[56] References Cited

U.S. PATENT DOCUMENTS

| | | | |
|---|---|---|---|
| 575,876 | 1/1897 | Chattaway . | |
| 664,528 | 12/1900 | Brauers | 473/48 |
| 934,163 | 9/1909 | Gormon | 473/49 |
| 1,130,726 | 3/1915 | Grove | 403/348 |
| 1,332,898 | 3/1920 | Hossie et al. . | |
| 1,495,842 | 5/1924 | Gulfi | 473/49 |
| 1,893,396 | 1/1933 | Bullough | 473/44 |
| 3,392,976 | 7/1968 | Hayes | 473/48 |
| 3,462,147 | 8/1969 | Mancuso | 473/44 |
| 4,231,574 | 11/1980 | Williams . | |
| 4,858,926 | 8/1989 | Cabianca | 473/47 |
| 4,906,147 | 3/1990 | Friesinger et al. . | |
| 5,334,101 | 8/1994 | McDermott | 473/44 |

FOREIGN PATENT DOCUMENTS

| | | | |
|---|---|---|---|
| 342969 | 2/1931 | United Kingdom | 473/44 |
| 2190800 | 1/1988 | United Kingdom | 473/44 |
| 2222091 | 2/1990 | United Kingdom | 473/44 |
| 2226851 | 6/1990 | United Kingdom | 473/44 |
| 2246302 | 1/1992 | United Kingdom | 473/44 |

*Primary Examiner*—Theatrice Brown
*Attorney, Agent, or Firm*—Daniel Robbins

[57] ABSTRACT

A billiard cue having a separate handle and shaft utilizes a quick operating connector to join the handle and shaft. The connector consists of male and female sections which are secured in the ends of the handle and shaft. The male section contains a cylindrical bar having an accurately machined diameter which snugly fits into a cylindrical cavity of the female section which is slightly oversized with respect to the male bar's diameter. The male bar and female cavity are axially aligned in the cue sections, and the bar engages the cavity over a linear distance sufficient to ensure accurate alignment of the handle and shaft when joined. Two flats at the end of the male bar provide a reduced diameter portion of the bar tip which fits between partial bulkheads within the female cavity, allowing insertion of the bar into the cavity. Upon a 90 degree rotation of the handle with respect to the shaft, the full diameter of the tip is captured behind the partial bulkheads and the two sections of the cue are mutually aligned and secured. In a second embodiment, when the male and female sections are mated, a compressible ring is in face to face contact with a flange on the male and a flange on the female sections of the connector. When a cue utilizing the connector strikes a billiard ball, the ring is compressed by the flanges and acts as a shock absorber for the impulse force transmitted through the cue.

10 Claims, 2 Drawing Sheets

BILLIARD CUE HAVING AN AXIAL ALIGNING SHAFT-HANDLE CONNECTOR

This is a continuation-in-part of application Ser. No. 08/354,243, filed Dec. 12, 1994, now abandoned.

BACKGROUND OF THE INVENTION

1. Field of the Invention

This invention relates to a billiard cue, and in particular to a billiard cue having a quick operating connector for joining the handle to the shaft.

2. Description Relative to the Prior Art

Billiard cues having a connector for joining the handle to the shaft are known in the prior art. Because the typical billiard cue has a length of 60 inches, it is convenient to separate the handle from the shaft to provide ease of handling during transportation. Also, where space is limited around a billiard table the use of interchangeable handles of shorter or longer lengths provides flexibility in making the billiard shot, and by means of the connector handles of differing weights may be quickly connected to a shaft to modify the heft of the cue. Billiard cues having such features are disclosed in U.S. Pat. No. 3,462,147, "Sectional Billiard Cue with Easy Detachment Feature", and U.S. Pat. No. 4,231,574, "Billiard Cue Having a Quick Connector for the Handle Portion Thereof". However, the prior art does not address the important requirement that the connector maintain the handle and shaft of the cue axially true while still providing the advantages of a quick connect and disconnect operation. The axially aligning quick operating connector of the present invention provides such alignment of the handle and shaft.

SUMMARY OF THE INVENTION

A billiard cue having a separate handle and shaft utilizes a quick operating connector to join the handle and shaft. The connector consists of male and female sections which are secured in the ends of the handle and shaft. The male section contains a cylindrical bar having an accurately machined diameter which snugly fits into a cylindrical cavity of the female section which is slightly oversized with respect to the male bar's diameter. The male bar and female cavity are axially aligned in the cue sections, and the bar engages the cavity over a linear distance sufficient to ensure accurate alignment of the handle and shaft when joined. Two flats at the end of the male bar provide a reduced diameter portion of the bar tip which fits between partial bulkheads within the female cavity, allowing insertion of the bar into the cavity. Upon a 90 degree rotation of the handle with respect to the shaft, the full diameter of the tip is captured behind the partial bulkheads and the two sections of the cue are mutually aligned and secured. The end face of the bar includes a slot which engages a spring loaded pin in the cavity forcing the handle and shaft into a firm mating connection.

BRIEF DESCRIPTION OF THE DRAWINGS

The invention will be described with respect to the drawings of which.

DESCRIPTION OF THE PREFERRED EMBODIMENT

Figure 1:
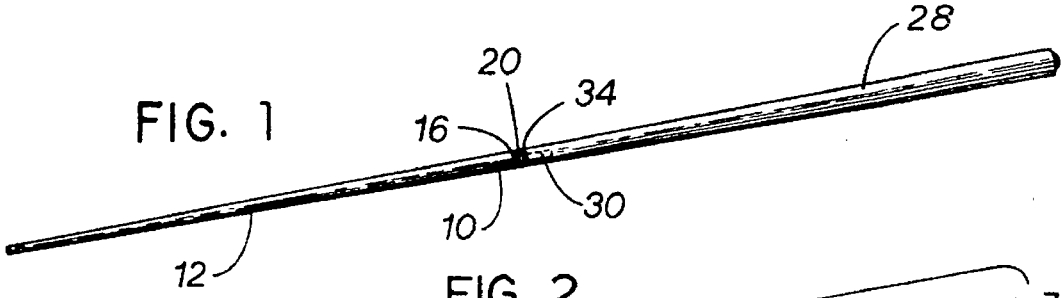
FIG. 1 is a perspective drawing of a billiard cue with the invention in position.
Figure 2:
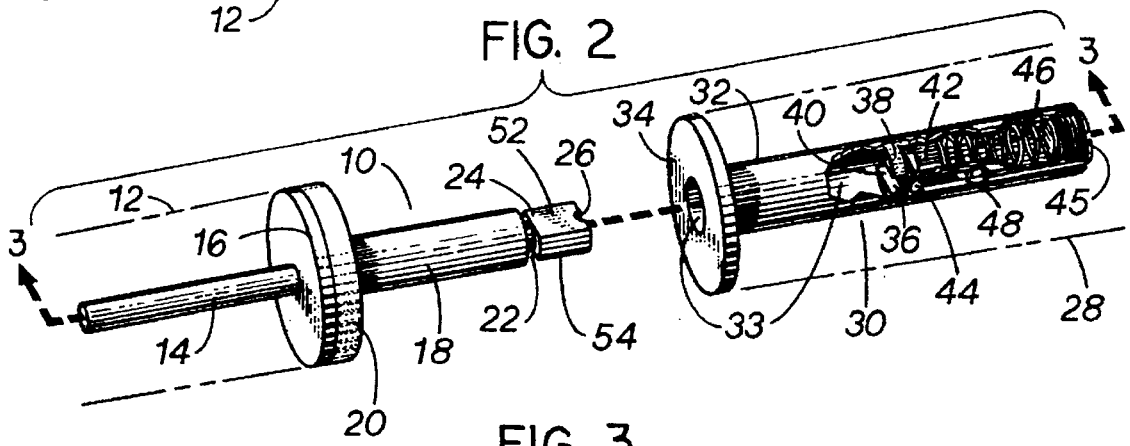
FIG. 2 is a perspective drawing of the connector of the invention prior to connection.

As seen in FIG. 1, a male section 10 of the connector of the invention is fastened into the shaft portion 12, and a female section 30 of the connector is fastened into the handle portion 28 of a two piece wooden billiard cue. Referring to FIG. 2, a rod 14 is epoxied into a mating hole of the shaft portion 12 permanently affixing the male section 10 to the shaft portion 12. A flange 16 which abuts the end of the shaft 12 is integral with the rod 14, as is a cylindrical bar 18. The flange 16, rod 14 and cylindrical bar 18 are preferably machined from a single piece of stainless steel, and are all coaxially aligned. A teflon ring 20 is press fit over the bar 18 and sits snugly against the flange 16. A circumferential groove 22 around the bar 18 provides a tip 24 to the male section 10. A locking notch 26 is cut into the end face of the bar 18.

The female section 30 of the connector is coaxially secured in a cylindrical hole in the wooden handle 28 by means of epoxy or other fastening means. The female portion 30 comprises a stainless steel thin wall cylindrical tube 32 provided with a flange 34 which engages the end of the handle 28. The interior of the cylindrical tube 32 is a cavity 33 into which the cylindrical bar 18 of the male portion 10 snugly slides when the handle 28 is joined to the shaft 12 by operation of the connector. Partial bulkheads 36, 38 neck down the cavity 33 to form an entry way 40, and a slide 42 having a transverse pin 44 mounted in a notch on its face is urged towards the partial bulkheads 36, 38 by a spring 46 engaging the opposite face of the slide 42. A screw 45 retains the spring 46. The transverse pin 44 extends across the face of the slide 42 in a notch, and rides in slots 48, 50 in the wall of the tube 32.

Figure 3:
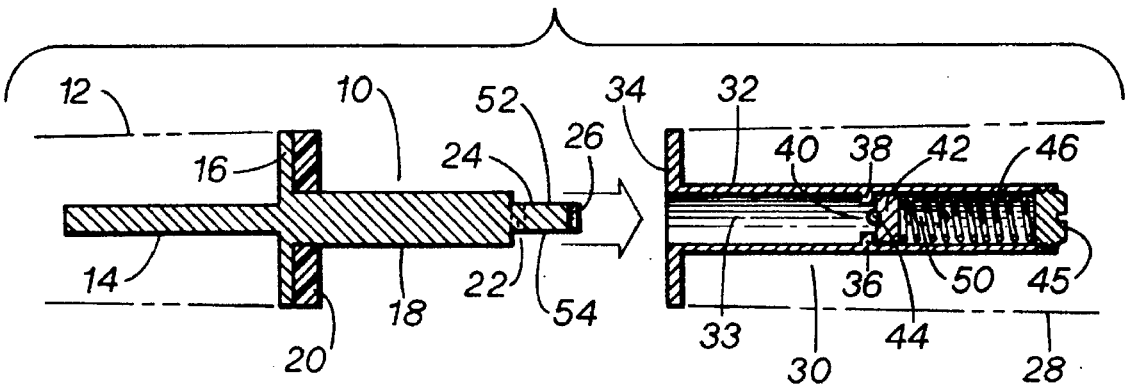
FIG. 3 is an axial cross-section drawing of the connector of the invention prior to connection.
Figure 4:
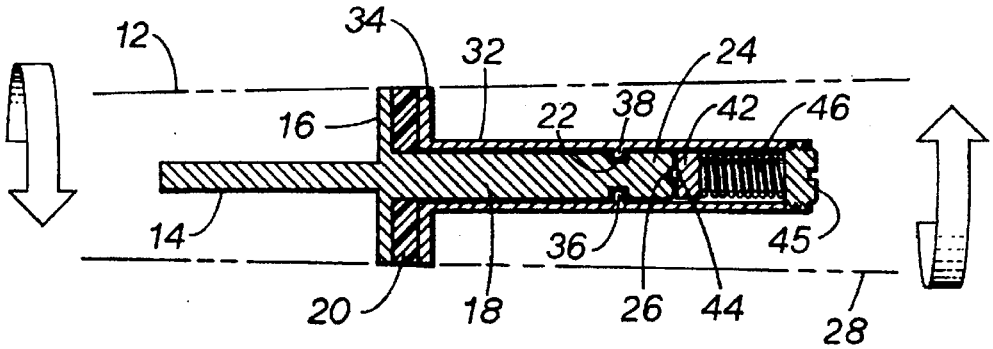
FIG. 4 is an axial cross-section drawing of the connector of the invention after connection.

FIG. 2 shows two flats 52, 54 on opposite sides of the tip 24 which extend back to the circumferential groove 22 in the tip 24, along with the orientation of the notch 26 relative to the flats 52, 54. The female portion 30 as seen in FIG. 3 shows the partial bulkheads 36, 38 forming the entry way 40, and the pin 44 riding in the slots 48 (FIG. 2), and 50 (FIG. 3).

The operation of the connector in joining the shaft 12 to the handle 28 takes place in the following manner. The shaft 12 and the handle 28 are placed in the orientation as seen in FIG. 2. The handle 28 is mated to the shaft 12 by insertion of the cylindrical bar 18 into the cavity 33; the cylindrical bar 18 fitting snugly into the cavity 33 as it is coaxially advanced through the cavity 33. It will be noted the reduced portion of the tip 24 will now clear the partial bulkheads 36, 38 (FIGS. 2–3) and allow passage of the tip 24 through the entry way 40; the tip 24 pushing against the pin 44 causing the slide 42 to compress the spring 46. When the circumferential groove 22 has aligned itself with the partial bulkheads 36, 38, the handle 28 and shaft 12 are then rotated 90 degrees relative to each other and the full diameter of the tip 24 is held captive against the partial bulkheads 36, 38. The pin 44 drops into the notch 26 inhibiting further rotation, and the spring 46 urges the male portion 10 and female portion 30 into firm engagement with each other. The teflon ring 20 contacting the flange 34 provides lubrication during rotation of the handle 28 relative to the shaft 12. It will be noted that the flanges 16, 34 and the teflon ring 20 are appropriately tapered to provide the smooth overall taper of the assembled cue.

Figure 5:
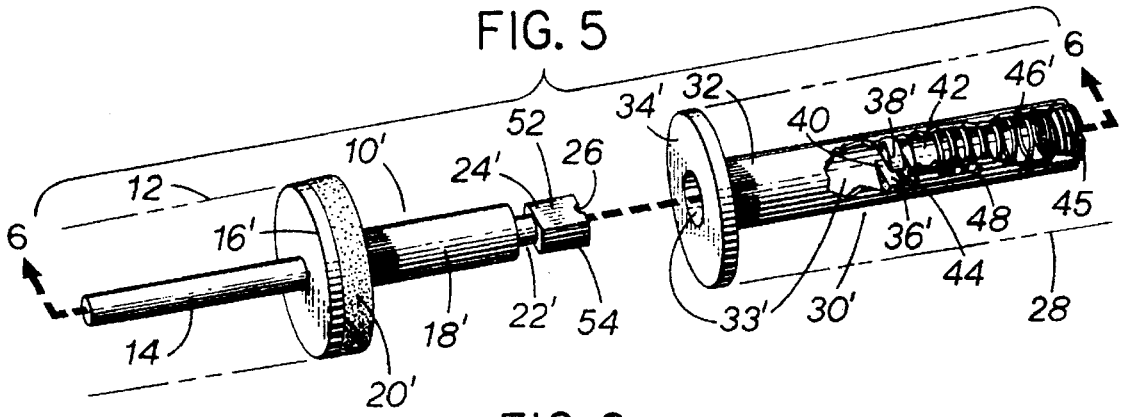
FIG. 5 is a drawing of a second embodiment of the connector of the invention prior to connection.
Figure 6:
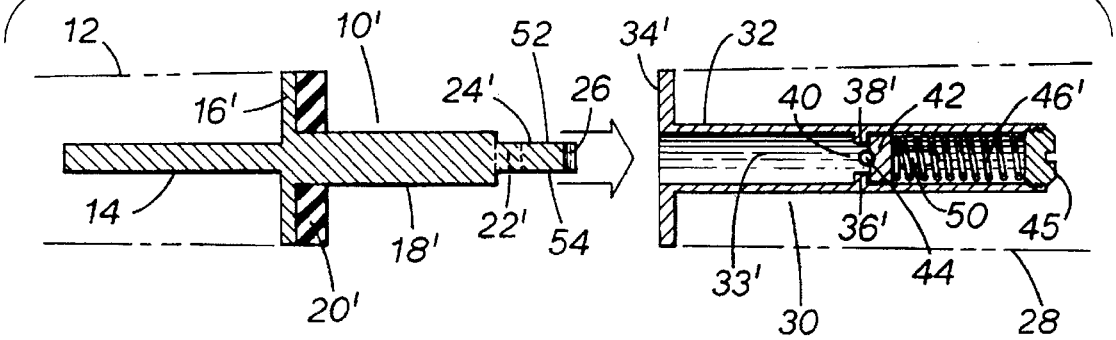
FIG. 6 is an axial cross-section drawing of a second embodiment of connector of the invention prior to connection.
Figure 7:
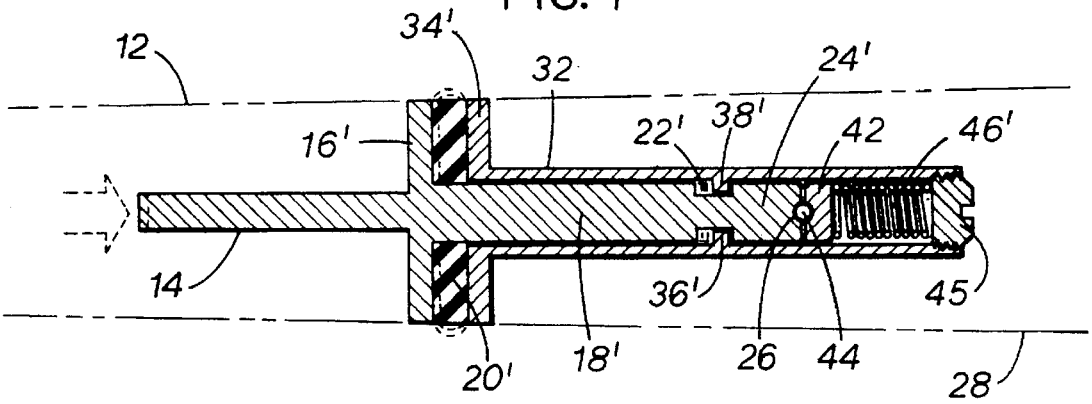
FIG. 7 is an axial cross-section drawing of the second embodiment of the connector of the invention after connection and under the impact of a cue incorporating the connector striking a billiard ball.

In a second embodiment of the invention, the connector is partially "free floating" in the axial direction to allow the connector, rather than the billiard player's arm, to absorb the shock generated by the cue striking the billiard ball. Referring to FIGS. 5 and 6, the circumferential groove 22' is axially lengthened to allow slight translational movement of the male tip 24' deeper into the cavity 33' behind the partial bulkheads 36', 38' against the spring 46' pressure, when the cue strikes the cue ball. FIG. 7 shows the displacement of the tip 24' under the striking force impulse transmitted through the connector. The ring 20', tapered to provide a smooth transition between the male 10' and female 30' sections of the connector, is a shock absorbent compressible material such as rubber or resilient dissipative plastic which is compressed between the flanges 16', 34' under the impact of the strike to dissipate the energy of the strike transmitted through the cue. The cavity 33' and the cylindrical bar 18' are configured for a mating sliding axial fit with negligible radial play. (In the drawings, different but related elements are identified by the same reference character, albeit that the different elements are distinguished by primes. Unprimed elements in FIGS. 5–7 are identical to the elements with same reference numbers of FIGS. 1–4).

The invention has been described in detail with particular reference to preferred embodiments thereof, but it will be understood that variations and modifications can be effected within the spirit and scope of the invention.

What is claimed is:

1. A billiard cue, comprising:

a) a first wooden cue member symmetrical about a first axis, b) a second wooden cue member symmetrical about a second axis, c) a connector having elongated male and female members, said female connector member having a cylindrical female cavity portion joined to said first wooden member; said female cavity portion having an open end, a closed end and an axis aligned along said first axis, said female connector member having a first circumferential flange positioned at said open end of said cavity, d) said female connector member further having a pair of opposed bulkheads transversely extending partially across said female cavity portion intermediate the end thereof; a spring loaded axially moveable slide having a detent pin attached thereto, said detent pin being transversely oriented across said female cavity portion in a region between said bulkheads and said closed end of said cavity; spring means positioned between said closed end and said slide axially urging said slide into contact with said bulkhead and a second end of said spring in contact with said closed end of said cavity, e) said male connector member having a first cylindrical male non-threaded portion joined to said second wooden cue member; the axis of said non-threaded male portion being aligned along said second axis, f) said male connector member further having a second male portion aligned with said first portion, said second portion being adapted to provide a snug fit in said female cavity portion whereby said first axis and said second axis of said first and said second cue members are mutually axially aligned when said male connector member second portion is inserted into said cavity of said female connector member; said male connector member having a circumferential flange intermediate said first and second portions;

g) said second male portion having a transverse notch at the end thereof, and further having a partial flattened segment for passing between said opposed bulkheads and having a partial cylindrical segment, whereby said partial flattened segment becomes captive between said opposed bulkheads and said slide when said second male portion is inserted into said female cavity portion and said first wooden cue member or said second wooden cue member is rotated by a single 90 degree rotation relative to the other cue member causing said detent pin to engage said notch for a quick connection by temporarily locking said male member to said female member under pressure of said spring, h) a ring of rigid material circumferentially located about said first axis intermediate said first and second portions and when said second portion of said male member is locked to said female cavity, said ring then being in facial contact with said first flange and said second flange, and i) said pin being disconnected from said notch by a further single 90 degree rotation of said first cue member relative to said second cue member.

2. The billiard cue of claim 1 wherein said ring is a teflon ring.

3. A connector for joining a shaft section and a handle section of a separable billiard cue, said connector comprising:

a) a connector having elongated male and female members, said female connector having a cylindrical female cavity portion, said female connector member for incorporation into said handle section, said female cavity portion further having an open end, a closed end, and an axis, said female connector member having a first circumferential flange axially located at said open end of said cavity, b) said female connector member further having a pair of opposed bulkheads transversely extending partially across said female cavity portion intermediate the end thereof; a spring loaded axially moveable slide having a detent pin attached thereto, said detent pin being transversely oriented across said female cavity portion in a region between said bulkheads and said closed end of said cavity; spring means positioned between said closed end and said slide axially urging said slide into contact with said bulkhead and a second end of said spring in contact with said closed end of said cavity, c) said male connector member having a first cylindrical male non-threaded portion, for incorporation into said shaft section, d) said male connector member having a second male portion aligned with said first portion, said second portion further adapted to provide a snug fit in said female cavity portion when said second male portion is inserted into said cavity of said female connector member, said male connector member having a second circumferential flange intermediate said first and second portions, e) said second male portion having a transverse notch at the end thereof, and further having a partial flattened segment for passing between said opposed bulkheads and having a partial cylindrical segment, wherein said partial flattened segment becomes captive between said opposed bulkheads and said slide when said second male portion is inserted into said female cavity portion and said male or said female member is rotated by a single 90 degree rotation relative to the other member causing said detent pin to engage said notch for a quick connection by temporarily locking said male member to said female member under pressure of said spring, f) a ring of rigid material circumferentially located about said male member intermediate said first and second portions and when said second portion of said male member is locked to said female cavity, said ring then being in facial contact with said first flange and said second flange, and g) said pin being disconnected from said notch by a further single 90 degree rotation of said male member relative to said female member.

4. The billiard cue of claim 3 wherein said ring is a teflon ring.

5. A billiard cue, comprising:

a) a first wooden cue member symmetrical about a first axis, b) a second wooden cue member symmetrical about a second axis, c) a connector having elongated male and female members, said female connector member having a cylindrical female cavity portion joined to said first wooden member; said female cavity portion having an open end, a closed end and an axis aligned along said first axis, said female connector member having a first circumferential flange positioned at said open end of said cavity, d) said female connector member further having a pair of opposed bulkheads transversely extending partially across said female cavity portion intermediate the end thereof; a spring loaded axially moveable slide having a detent pin attached thereto, said detent pin being transversely oriented across said female cavity portion in a region between said bulkheads and said closed end of said cavity; spring means positioned between said closed end and said slide axially urging said slide into contact with said bulkhead and a second end of said spring in contact with said closed end of said cavity, e) said male connector member having a first cylindrical male non-threaded portion joined to said second wooden cue member; the axis of said non-threaded male portion being aligned along said second axis, f) said male connector member further having a second male portion aligned with said first portion, said second portion being adapted to provide an axial sliding fit in said female cavity portion wherein said first axis and said second axis of said first and said second cue members are mutually axially aligned when said male connector member second portion is inserted into said cavity of said female connector member; said male connector member having a circumferential flange intermediate said first and second portions;

g) said second male portion having a transverse notch at the end thereof, and further having a partial flattened segment for passing between said opposed bulkheads and having a partial cylindrical segment, wherein said partial flattened segment becomes captive between said opposed bulkheads and said slide when said second male portion is inserted into said female cavity portion, said flattened segment having a circumferential groove immediately adjacent to said segment, said groove having an axial length which allows axial movement of said second male portion relative to said female cavity when said flattened segment is captive, and further when said first wooden cue member or said second wooden cue member is rotated by a single 90 degree rotation relative to the other cue member causing said detent pin to engage said notch for a quick connection by temporarily locking said male member to said female member under pressure of said spring, h) a ring of compressible material circumferentially located about said first axis intermediate said first and second portions and when said second portion of said male member is locked to said female cavity said ring then being in facial contact with said first flange and with said second flange, and whereby when said cue imparts a strike to a billiard ball said male member is impulsively driven further into said cavity compressing said ring between said first flange and said second flange to absorb the shock of said strike, and i) said pin being disconnected from said notch by a further single 90 degree rotation of said first cue member relative to said second cue member.

6. The billiard cue of claim 5 wherein said ring is a tapered ring.

7. The billiard cue of claim 5 wherein said ring is a rubber ring.

8. A connector for joining a shaft section and a handle section of a separable billiard cue, said connector comprising:

a) a connector having elongated male and female members, said female connector member having a cylindrical female cavity portion for incorporation into said handle section, said female cavity portion having an open end, a closed end and an axis, said female connector member having a first circumferential flange axially located at said open end of said cavity, b) said female connector member further having a pair of opposed bulkheads transversely extending partially across said female cavity portion intermediate the end thereof; a spring loaded axially moveable slide having a detent pin attached thereto, said detent pin being transversely oriented across said female cavity portion in a region between said bulkheads and said closed end of said cavity; spring means positioned between said closed end and said slide axially urging said slide into contact with said bulkhead and a second end of said spring in contact with said closed end of said cavity;

c) a male connector member having a first cylindrical male non-threaded portion for incorporation into said shaft section, d) said male connector member having a second male portion aligned with said first male portion, said second male portion further adapted to provide a sliding axial fit in said female portion when said second male portion is inserted into said cavity of said female connector member; said male connector member having a circumferential flange intermediate said first and second male portions;

e) said second male portion having a transverse notch at the end thereof, and further having a partial flattened segment for passing between said opposed bulkheads and having a partial cylindrical segment, wherein said partial flattened segment becomes captive between said opposed bulkheads and said slide when said second male portion is inserted into said female cavity portion, said flattened segment having a circumferential groove immediately adjacent to said segment, said groove having an axial length which allows axial movement of said second male portion relative to said female cavity when said flattened segment is captive, and further when said male member or said female member is rotated by a single 90 degree rotation relative to the other member causing said detent pin to engage said notch for a quick connection by temporarily locking said male member to said female member under pressure of said spring, f) a ring of compressible material circumferentially located about said male member intermediate said first and second portions and when said second portion of said male member is locked to said female cavity said ring being in facial contact with said first flange and with said second flange, and whereby when said cue imparts a strike to a billiard ball said male member is impulsively driven further into said female cavity compressing said ring between said first flange and said second flange to absorb the shock of said strike, and g) said pin being disconnected from said notch by a further single 90 degree rotation of said male connector member relative to said female connector member.

9. The connector of claim 8 wherein said ring is a tapered ring.

10. The connector of claim 8 wherein said ring is a rubber ring.

* * * * *